United States Patent [19]

Anderson, Jr.

[11] Patent Number: 4,936,796

[45] Date of Patent: Jun. 26, 1990

[54] AUTO ACCESSORY ELECTRICAL ADAPTOR

[76] Inventor: Phelix Anderson, Jr., 2927A Tobacco Rd., Hephzibah, Ga. 30815

[21] Appl. No.: 381,868

[22] Filed: Jul. 19, 1989

[51] Int. Cl.[5] ..... H01R 11/00; H01R 13/70; H01R 33/94

[52] U.S. Cl. ..... 439/620; 439/504

[58] Field of Search ..... 320/25; 30/500; 439/34, 439/35, 501, 502–505, 756, 757, 765, 771; 219/264

[56] References Cited

U.S. PATENT DOCUMENTS

| | | | |
|---|---|---|---|
| 3,238,353 | 3/1966 | Lybrook | 219/264 X |
| 3,259,754 | 7/1966 | Matheson . | |
| 3,456,181 | 7/1969 | Godshalk . | |
| 4,021,732 | 5/1977 | Metcalf . | |
| 4,261,634 | 4/1981 | Robinson | 439/622 X |
| 4,647,139 | 3/1987 | Yang | 439/501 X |
| 4,726,786 | 2/1988 | Hill | 439/504 |

*Primary Examiner*—Eugene F. Desmond
*Attorney, Agent, or Firm*—Jerry T. Kearns

[57] ABSTRACT

An auto accessory electrical adaptor is designed to allow auto electrical accessory items to be operated remotely from a vehicle. Various electrical accessories include a plug for engagement with a cigarette lighter socket in a vehicle, and are thus not conveniently operable remotely therefrom. The present invention provides a cylindrical body formed from a nonconductive plastic material having a central cylindrical bore lined with a metallic sleeve dimensioned for insertion of a standard cigarette lighter auto electrical accessory plug. A cylindrical insulating disk is mounted in the sleeve, adjacent one end of the body and includes a spring metal contact mounted on an outer face. End portions of a pair of insulated wires are connected to the spring metal contact and to the metallic sleeve. Opposite ends of the wires are connected to electrical connectors for engagement with opposite terminals of a battery or a battery charger to provide a DC power supply to an electrical auto accessory item. In a second embodiment of the present invention, the cylindrical body is located in a switch box which includes a switch for selectively disconnecting the power supply from the electrical accessory.

5 Claims, 3 Drawing Sheets

AUTO ACCESSORY ELECTRICAL ADAPTOR

BACKGROUND OF THE INVENTION

1. Field of the Invention

The present invention relates to electrical adaptors, and more particularly pertains to an auto accessory electrical adaptor which allows various auto accessory electrical items to be operated remotely from a vehicle. Various types of auto accessory items such as vacuum cleaners, polishers, compressors and the like are provided with cigarette lighter plugs for engagement in the cigarette lighter socket of a vehicle. However, because these devices require a availability of a cigarette lighter socket for operability, they are not conveniently usable remotely from the vehicle. Additionally, these auto electrical accessory items are frequently less expensive than their AC counterparts, designed for home usage. In order to allow these D.C. auto accessory items to be operated in a home or business environment located remotely from a vehicle, the present invention provides an adaptor for connection with a battery or a battery charger to provide a D.C. power source.

2. Description of the Prior Art

Various types of electrical adaptors are known in the prior art. A typical example of such an electrical adaptor is to be found in U.S. Pat. No. 3,259,754, which issued to L. Matheson on Jul. 5, 1966. This patent discloses a polarity testing device including a lamp having a pair of spring biased clamping jaws for engagement with opposite clamping jaws of a set of jumper cables. U.S. Pat. No. 3,456,181, which issued to J. Godshalk on Jul. 15, 1969, discloses a device for connecting an auxiliary battery to the electrical system of a vehicle. U.S. Pat. No. 4,021,732, which issued to J. Metcalf on May 3, 1977, discloses an electrical tester adapted to perform an electrical test by tapping the battery current of a flashlight. The device includes a pair of electrical leads connected at one end in a banana type plug and provided at an opposite end with a pair of alligator type clips.

While the above mentioned devices are directed to electrical adaptors, none of these devices disclose an electrical adaptor which allows auto electrical accessory items to be operated remotely from a vehicle. Inasmuch as the art is relatively crowded with respect to these various types of electrical adaptors, it can be appreciated that there is a continuing need for and interest in improvements to such electrical adaptors, and in this respect, the present invention addresses this need and interest.

SUMMARY OF THE INVENTION

In view of the foregoing disadvantages inherent in the known types of electrical adaptors now present in the prior art, the present invention provides an improved auto accessory electrical adaptor. As such, the general purpose of the present invention, which will be described subsequently in greater detail, is to provide a new and improved auto accessory electrical adaptor which has all the advantages of the prior art electrical adaptors and none of the disadvantages.

To attain this, representative embodiments of the concepts of the present invention are illustrated in the drawings and make use of an auto accessory electrical adaptor designed to allow auto electrical accessory items to be operated remotely from a vehicle. Various electrical accessories include a plug for engagement with a cigarette lighter socket in a vehicle, and are thus not conveniently operable remotely therefrom. The present invention provides a cylindrical body formed from a nonconductive plastic material having a central cylindrical bore lined with a metallic sleeve dimensioned for insertion of a standard cigarette lighter auto electrical accessory plug. A cylindrical insulating disk is mounted in the sleeve, adjacent one end of the body and includes a spring metal contact mounted on an outer face. End portions of a pair of insulated wires are connected to the spring metal contact and to the metallic sleeve. Opposite ends of the wires are connected to electrical connectors for engagement with opposite terminals of a battery or a battery charger to provide a DC power supply to an electrical auto accessory item. In a second embodiment of the present invention, the cylindrical body is located in a switch box which includes a switch for selectively disconnecting the power supply from the electrical accessory.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved auto accessory electrical adaptor which has all the advantages of the prior art electrical adaptors and none of the disadvantages.

It is another object of the present invention to provide a new and improved auto accessory electrical adaptor which may be easily and efficiently manufactured and marketed.

It is a further object of the present invention to provide a new and improved auto accessory electrical adaptor which is of a durable and reliable construction.

An even further object of the present invention is to provide a new and improved auto accessory electrical adaptor which is susceptible of a low cost of manufacture with regard to both materials and labor, and which accordingly is then susceptible of low prices of sale to the consuming public, thereby making such electrical adaptors economically available to the buying public.

Still yet another object of the present invention is to provide a new and improved auto accessory electrical adaptor which provides in the apparatuses and methods of the prior art some of the advantages thereof, while simultaneously overcoming some of the disadvantages normally associated therewith.

Still another object of the present invention is to provide a new and improved auto accessory electrical adaptor which allows various auto electrical accessory items to be operated remotely from a vehicle.

Yet another object of the present invention is to provide a new and improved auto accessory electrical adaptor which allows various motorized auto electrical accessory items to be operated remotely from a vehicle through connection with a battery or a battery charger.

Even still another object of the present invention is to provide a new and improved auto accessory electrical adaptor which allows individuals to use motorized auto electrical accessories remotely from a vehicle to avoid the expense of purchasing duplicate A.C. powered devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
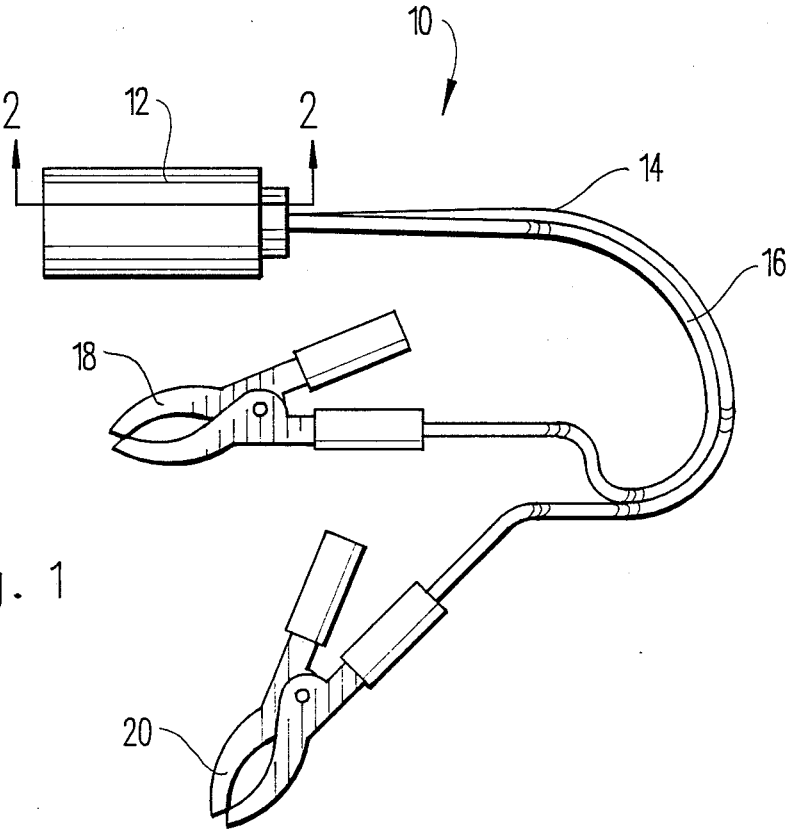
FIG. 1 is a side view of the adaptor according to a first embodiment of the present invention.

With reference now to the drawings, and in particular to FIG. 1 thereof, a new and improved auto accessory electrical adaptor embodying the principles and concepts of the present invention and generally designated by the reference numeral 10 will be described.

More specifically, it will be noted that the first embodiment 10 of the invention includes a cylindrical body 12, preferably formed from a nonconductive plastic material. A pair of insulated electrical wires 14 and 16 have free ends which are connected to a pair of spring biased clamps 20 and 18, respectively, adapted for connection with opposite terminals of a 12 volt automotive battery or a battery charger.

Figure 2:
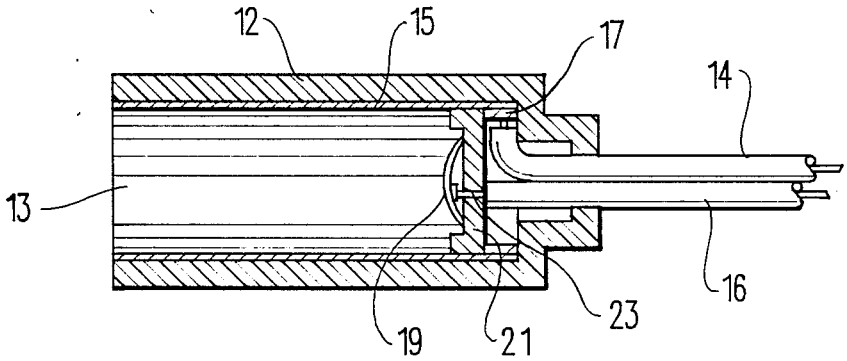
FIG. 2 is a cross sectional view, taken along line 2—2 of FIG. 1.

As shown in FIG. 2, a cylindrical bore 13 is formed within the body 12 and is lined with a metallic sleeve 15 dimensioned for insertion of a standard cigarette lighter auto electrical accessory plug. A cylindrical insulating disk 21 is mounted within the sleeve 15, adjacent an inner end of the bore 13. A spring metal contact 19 is mounted on an outer face of the disk 21 and is connected to an exposed end portion 23 of the insulated electrical wire 16. An exposed end portion 17 of the insulated electrical wire 14 is connected to the metallic sleeve 15.

Figure 3:
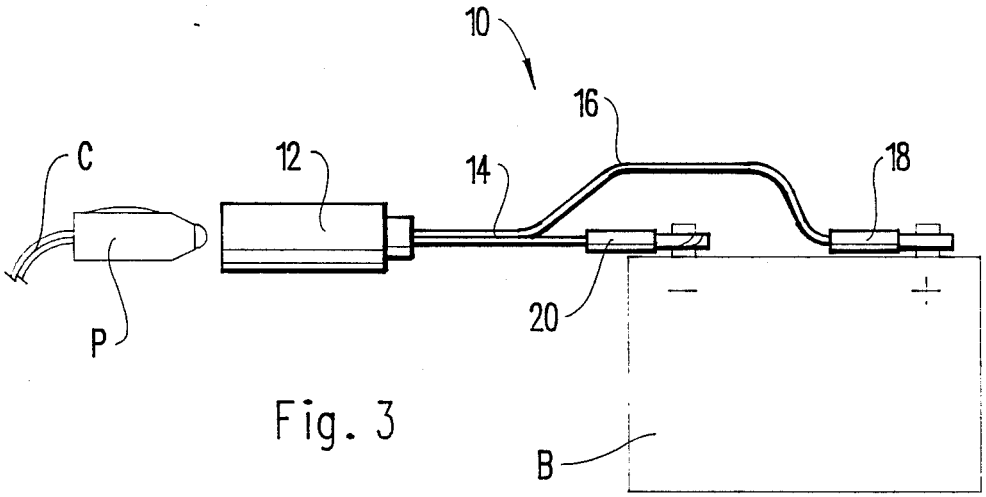
FIG. 3 is a side view which illustrates the manner of use of the adaptor of FIG. 1.

FIG. 3 illustrates the manner of use of the adaptor 10 illustrated in FIGS. 1 and 2. The spring biased clamps 18 and 20 are connected to opposite terminals of a conventional wet cell automotive type 12 volt battery B. A conventional cigarette lighter electrical accessory plug P is then inserted into the body 12. The plug P is connected to the power cord C of an electrical accessory item such as a vacuum, a compressor, a polisher, etc. The battery B may be disposed in a location remotely from a vehicle and allows the usage of various electrical accessory items remotely from a vehicle, and thus avoid the necessity of purchasing expensive A.C. powered devices.

Figure 4:
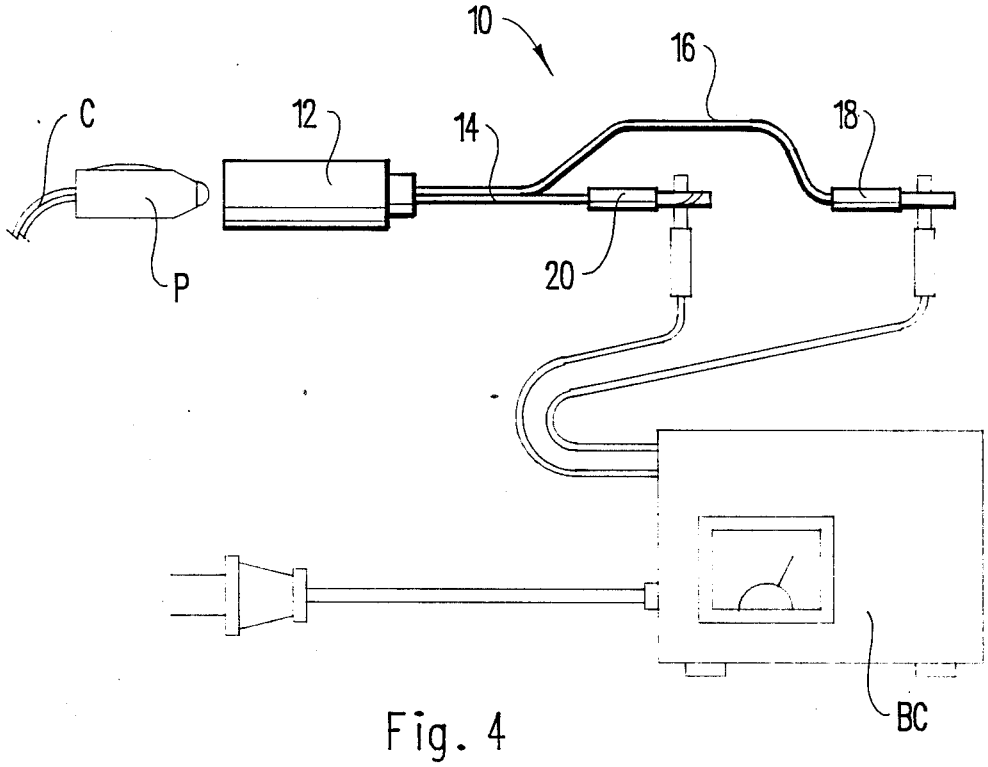
FIG. 4 is a side view which illustrates an alternative manner of using the electrical adaptor of FIG. 1.

FIG. 4 diagrammatically illustrates an alternative manner of utilizing the adaptor 10, in which the connecting jaw clamps 18 and 20 are connected to opposite terminals of a conventional A.C. powered batter charger BC which provides a source of D.C. power.

Figure 5:
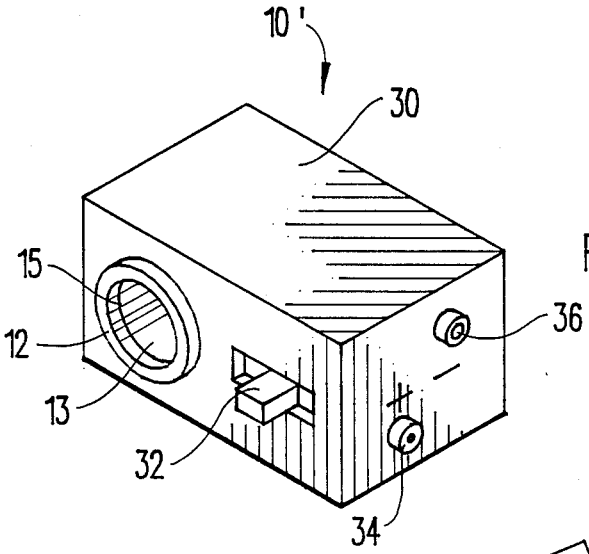
FIG. 5 is a perspective view which illustrates an electrical adaptor according to a second embodiment of the present invention.

FIG. 5 illustrates an alternative adaptor 10', in which the cylindrical body 12 is mounted within a switch box 30 and the wires 14 and 16 are electrically connected with a pair of jacks 34 and 36. A switch 32 is operatively connected to selectively disengage one of the electrical wires from one of the jacks 34 or 36, thus providing an on/off switch for an automobile electrical accessory item having a cigarette lighter plug engaged within the cylindrical bore 13 of the body 12.

Figure 6:
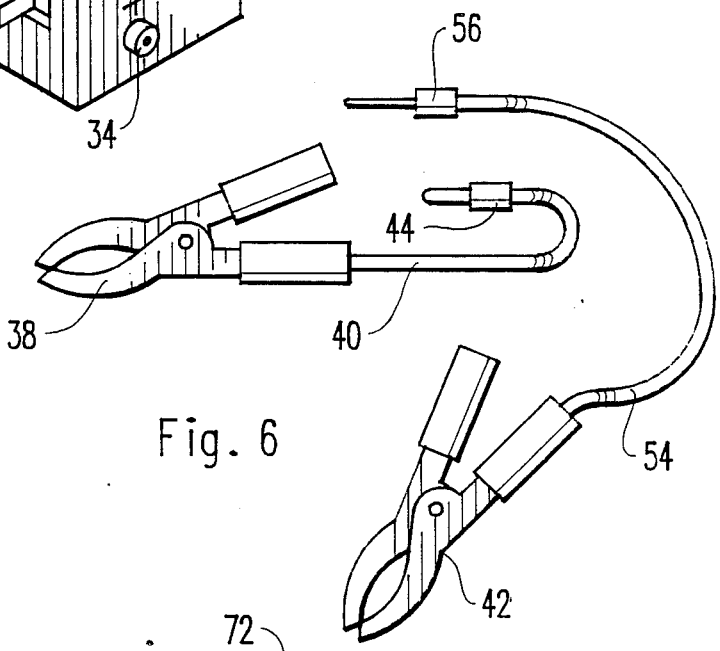
FIG. 6 is a side view which illustrates electrical leads for use with the adaptor of FIG. 5.

FIG. 6 illustrates a pair of electrical leads 40 and 54 which terminate in banana type plugs 44 and 56 each dimensioned for engagement with one of the jacks 34 and 36. Opposite ends of the leads 40 and 54 are provided with spring biased type clamps 38 and 42 for engagement with opposite terminals of a battery or a battery charger.

Figure 7:
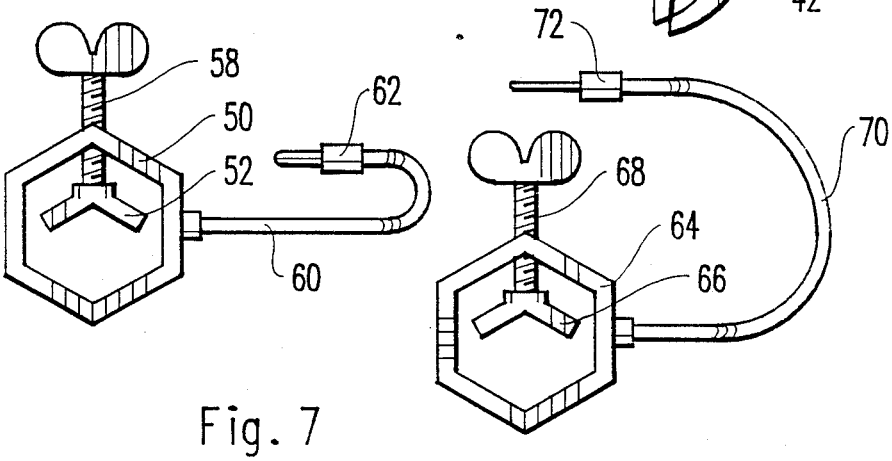
FIG. 7 illustrates an alternative pair of electrical leads for use with the adaptor of FIG. 5.

FIG. 7 illustrates an alternative pair of leads 60 and 70 for use with the adaptor of FIG. 5. The leads 60 and 70 terminate in respective banana type plug 62 and 72 for engagement with one of the jacks 34 and 36. An opposite end of each of the leads 60 and 70 is electrically connected to a metallic hexagonal body 50 having a hexagonal interior passage dimensioned for engagement with the terminal of a battery. The hexagonal bodies 50 and 64 are each provided with a transversely extending thread clamping thumb screw 58 and 68, each terminating in a V-shaped clamping member 52, 66 for securing the body 50, 64 on a battery terminal.

As may now be understood, the adaptors 10 and 10' of the present invention allow the usage of a variety of conventional D.C. electrical accessory items at a location remote from a vehicle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is a follows:

1. An auto accessory electrical adaptor, comprising:

a cylindrical body formed form a nonconductive plastic material;

a cylindrical bore formed centrally through said body and lined with a metallic conductive sleeve, said sleeve dimensioned for insertion of a standard cigarette lighter auto electrical accessory plug;

a cylindrical insulating disk in said sleeve, adjacent one end of said body;

a spring metal contact mounted on an outer face of said disk;

a first insulated wire having a first end portion connected to said spring metal contact and an opposite end connected to a first electrical connector;

a second insulated wire having a first end portion connected to said metallic sleeve and an opposite end connected to a second electrical connector, whereby said first and said electrical connectors may be connected to opposite terminals of a DC power source to power auto electrical accessory items located remotely from a vehicle;

and said first and second electrical connectors comprising spring biased clamps for engagement with terminals of a battery or a battery charger.

2. An auto accessory electrical adaptor, comprising:

a cylindrical body formed from a nonconductive plastic material;

a cylindrical bore formed centrally through said body and lined with a metallic conductive sleeve, said sleeve dimensioned for insertion of a standard cigarette lighter auto electrical accessory plug;

a cylindrical insulating disk in said sleeve, adjacent one end of said body;

a spring metal contact mounted on an outer face of said disk;

a first insulated wire having a first end portion connected to said spring metal contact and an opposite end connected to a first electrical connector;

a second insulated wire having a first end portion connected to said metallic sleeve and an opposite end connected to a second electrical connector, whereby said first and said electrical connectors may be connected to opposite terminals of a DC power source to power auto electrical accessory items located remotely from a vehicle;

and said first and second electrical connectors comprising hexagonal metallic bodies each having a hexagonal passage for insertion over a battery post and including a V-shaped clamping member disposed in said hexagonal passage and connected to a transversely extending clamping screw.

3. An auto accessory electrical adaptor, comprising:

a cylindrical body formed from a nonconductive plastic material;

a cylindrical bore formed centrally through said body and lined with a metallic conductive sleeve, said sleeve dimensioned for insertion of a standard cigarette lighter auto electrical accessory plug;

a cylindrical insulating disk in said sleeve, adjacent one end of said body;

a spring metal contact mounted on an outer face of said disk;

a first insulated wire having a first end portion connected to said spring metal contact and an opposite end connected to a first electrical connector;

a second insulated wire having a first end portion connected to said metallic sleeve and an opposite end connected to a second electrical connector, whereby said first and said electrical connectors may be connected to opposite terminals of a DC power source to power auto electrical accessory items located remotely from a vehicle;

and said cylindrical body disposed in a switch box and said first and second electrical connectors comprising a pair of jacks mounted on said switch box for insertion of electrical plugs.

4. The auto accessory electrical adaptor of claim 3, further comprising switch means in said switch box for disconnecting one of said wires from one of said jacks.

5. The auto accessory electrical adaptor of claim 4, further comprising a pair of electrical leads, each having one end provided with a plug dimensioned for engagement in one of said jacks and an opposite end provided with a connector for engagement with terminals of a battery or a battery charger.

* * * * *